United States Patent [19]

Yoshida et al.

[11] Patent Number: 4,650,525

[45] Date of Patent: Mar. 17, 1987

[54] SURFACE TREATMENT OF ALUMINUM AND ITS ALLOYS

[75] Inventors: Atsunori Yoshida; Hideaki Kaneko, both of Tokyo; Takao Ogino, Kanagawa, all of Japan

[73] Assignee: Nihon Parkerizing Co., Ltd., Tokyo, Japan

[21] Appl. No.: 721,812

[22] Filed: Apr. 5, 1985

[30] Foreign Application Priority Data

Apr. 10, 1984 [JP] Japan ..... 59-71334

[51] Int. Cl.[4] ..... C23C 23/34

[52] U.S. Cl. ..... 148/6.2; 148/6.27

[58] Field of Search ..... 148/6.27, 6.2

[56] References Cited

U.S. PATENT DOCUMENTS

| | | | |
|---|---|---|---|
| 1,638,273 | 8/1927 | Pacz | 148/6.27 |
| 2,213,263 | 9/1940 | Thompson | 148/6.27 |
| 3,592,747 | 7/1971 | Cohn | 148/6.27 |

FOREIGN PATENT DOCUMENTS

| | | | |
|---|---|---|---|
| 0022995 | 5/1982 | Japan | 148/6.27 |

*Primary Examiner*—Sam Silverberg

*Attorney, Agent, or Firm*—Arthur E. Kluegel

[57] ABSTRACT

A composition and process useful in forming films on the surface of aluminum or its alloys is disclosed. The composition is an aqueous solution containing an alkali metal, silicon, fluorine, zinc and iron. The film is an adherent hydrophilic corrosion resistant film useful as such and/or as a lubricating film in metal forming.

7 Claims, No Drawings

SURFACE TREATMENT OF ALUMINUM AND ITS ALLOYS

BACKGROUND OF THE INVENTION

This invention concerns a method of surface treatment for forming in a stable manner on an aluminum or aluminum alloy surface a film of which the principal component is aluminum fluoride.

Aluminum and its alloys are often used in applications such as heat exchangers, for example, where the metal comes into contact with moisture. In many heat exchangers the construction involves a very narrow fin spacing since such devices are designed in such a way as to maximize the heat releasing or cooling surface area as much as possible in order to improve the heating or cooling effects of the heat exchanger. As a consequence of this, moisture in the atmosphere condenses out on the surface of the heat exchanger and more precisely in the gaps between the fins when the heat exchanger is being used for cooling purposes. The condensed water readily forms spherical droplets as the surface of the fins is hydrophobic in nature and this tends to block up the gaps between the fins, the ventilation resistance is increased and the heat exchanging efficiency is reduced. Furthermore the water droplets which have collected in the gaps between the fins are dispersed by the air blower of the heat exchanger and the water is readily displaced to the water droplet receiver which is established in the bottom of the heat exchanger and this is disadvantageous in that the region in the vicinity of the heat exchanger becomes contaminated with water. On the other hand when the heat exchanger is used for central heating purposes frost may form on outdoor mechanisms during the winter season with a consequent reduction in the thermal efficiency. As a result the heat exchanger is run in reverse from time to time to heat up and defrost the outdoor mechanism. It is essential that the defrosting operation should require only a short period of time for its effective completion from the point of view of the function of the air conditioning system. The provision of hydrophilic fins is effective for the rapid removal of the water droplets which form as the machine is being defrosted. For these reasons the surface of a heat exchanger is surface treated to render it hydrophilic in nature and to improve its wetability with water so that blockages do not occur between the fins as a result of the water droplets which are retained in the gaps between the fins in the heating part or the cooling part of a heat exchanger. However if a treatment is simply given to improve the wetability of the surface the corrosion resistance for example becomes inadequate and in most cases an anticorrosion treatment is essential, especially in the case of heat exchangers which are made of aluminum.

Known methods of providing hydrophilic surfaces on heat exchangers include (1) methods in which a macromolecular resin skin film which contains silica particles, calcium carbonate or a surface active agent is formed on the surface, (2) methods in which water glass, lithium silicate or colloidal silica etc. is coated on top of an anodic oxidation skin film, a baymite skin film, a resin skin film or a chromate formed skin film, and (3) methods in which water glass, lithium silicate or colloidal silica etc. is coated directly onto the surface of the metal.

However mixed skin films consisting of a resin skin film and particles of silica or calcium carbonate which are solid hydrophilic particles as mentioned under (1) above do not form sufficiently hydrophilic surfaces readily since the surfaces of the solid hydrophilic particles are covered with the resin, while with resin films which contain surface active agents the surface active agent tends to be washed out from the resin by water and it is difficult to achieve lasting hydrophilicity in this way. The methods which involve coating with water glass, lithium silicate or fine silica particles mentioned in (2) and (3) above do provide a hydrophilic surface but the material is only poorly attached to the surface and is easily removed, particularly in areas where too much has been attached to the surface, and this is also disadvantageous in that the stripped solid forms a powder which is subsequently dispersed. Furthermore some of the water glass or lithium silicate etc. is dissolved in the water which condenses on the heat exchanger and this collects at the bottom of the fins and dries out when the air conditioning unit is turned off and this is disadvantageous in that a powder which is dispersed when the air conditioning unit is restarted is formed. The substances which are effective for providing a hydrophilic surface such as fine silica particles, calcium carbonate, water glass, lithium silicate etc. can be attached to the surface only with difficulty; the surface treatment for providing a hydrophilic surface is difficult; there are problems with the formation of excess skin film in places where the treatment liquid collects; the skin filming treatment has to be carried out in very small batches; and there is a further disadvantage in that as a result of these factors it is not possible to provide adequate hydrophilicity.

This invention is intended to overcome the disadvantages described above and the aims of the invention are to provide a method of surface treatment for aluminum and aluminum alloys which forms a uniform film which is firmly attached to the surface of the metal, in which the treatment solution has a long life and which moreover provides a good hydrophilic surface on the metal surface which is effective in practical terms.

SUMMARY OF THE INVENTION

In order to achieve these aims, in this invention a formed skin film is produced by treating a metal surface which consists of aluminum or aluminum alloy with a treatment solution (including a partial suspension) which contains 0.7–1 g/l of alkali metal, 0.4–8 g/l of silicon, 2–34 g/l of fluorine, 0.01–1.5 g/l of zinc and 0.05–1.0 g/l of iron and, by subsequently removing the excess treatment solution with a water rinse, to form a film with improved corrosion resistance and hydrophilicity which is free from film defects due to the accumulation of excess treatment solution. Moreover with this invention it is possible to form films with improved corrosion resistance by subjecting a film which has been produced with a treatment solution of the aforementioned composition to a post treatment such as chromic acid.

DETAILED DESCRIPTION OF THE INVENTION

A treatment solution of composition 0.7–14 g/l of alkali metal 0.4–8 g/of silicon, 2–34 g/l fluorine, 0.01–1.5 g/l of zinc and 0.05–1.0 g/l of iron is satisfactory in the invention but the preferred treatment solution composition is 2–8 g/l of alkali metal, 1.5–6 g/l of silicon, 5–24 g/l of fluorine, 0.2–1.0 g/l of zinc and 0.1–1.0 g/l of iron. Treatment solutions of these compositions are usually prepared in the form of dissolved salts but the treatment solution can include both salts and complexes. Furthermore if part of the composition of the treatment solution is of low solubility then in general a partial suspension of the insoluble material can be used.

If the concentrations of the various components is too high there is too much material in suspension in the treatment solution, some of the material becomes physically attached to the film and an uneven surface is easily produced, and this is also disadvantageous in consideration of the fact that it is taken up by the material which is to be coated.

Furthermore if the concentrations of the various components is generally low there is severe dissolution of the material which is being treated and conversely the rate of film formation is reduced and there is a further disadvantage in that the film which is formed is only poorly attached.

If the zinc concentration is less than 0.2 g/l the rate of film formation is low and there is a disadvantage in that excess time is needed to form the required film, and if the iron ion concentration is less than 0.05 g/l the adhesion of the film becomes poor. More precisely it is difficult to form films which are well attached at a film weight of 5 $g/m^2$ or more. Various iron salts can be used to adjust the iron ion concentration in a treatment solution of this invention but ideally the use of iron fluorides, which is to say salts which incorporate fluorine which is itself a component of a treatment solution of this invention is preferred. Furthermore it is even possible to supply iron ions by employing an iron tank for the treatment bath.

Any alkali metal such as sodium, potassium, lithium etc. may be used for the alkali metal.

Silicon and fluorine are the principal components of the film and the fluoride ion also etches the surface of the aluminum and promotes the chemical reaction and this is an essential component of the treatment solution.

The conditions of treatment are preferably a bath temperature of 40°-100°C. with a treatment time of at least 5 seconds, depending on the composition of the treatment solution. The hydrogen ion concentration of the treatment solution is preferably within the range pH 3-7 and optimally it is within the range pH 4-5. The hydrogen ion concentration is adjusted using acidic fluorides and caustic soda which contain some of the components of the treatment solution.

The principal components of the films which are formed with treatment solutions of this invention are $Na_3AlF_6$ 70% by weight, Zn 20% by weight, Fe 9% by weight, remainder Si. The films which are formed with treatment solutions of this invention generally have a weight of 0.1-10 $g/m^2$, they are resistant to wear, corrosion resistant and easily wetted with water.

These films are useful in that they are resistant to wear and by selecting the optimum film weight the film can be employed as a lubricant for plastic working such as drawing after cold forging aluminum products. In this case the lubricant film for plastic working must be well attached. Thus if the attachment of the film is inadequate the base material is easily damaged and incidents such as die blockage are liable to occur. Generally speaking a film weight of 2-10 $g/m^2$ is required for a lubricating film for plastic working and a treatment solution with which the time required for film formation is short and in which the film which is formed is well attached is required. A treatment solution of this invention satisfies these requirements. Furthermore the material is generally coated with a sodium soap based lubricant or a lubricating oil in order to improve the performance of the lubricating film. Additionally the film which is formed is corrosion resistant and easily wetted with water. By treating the aluminum surfaces of a heat exchanger in this way it is possible to provide heat exchangers which have surfaces on which water droplets can form only with difficulty, in which the air resistance is reduced and which have an improved heat exchanging efficiency. Moreover the corrosion resistance can be improved to a remarkable degree by subjecting a film which has been formed in accordance with the method of this invention to a post treatment.

The post treatment may be any conventional post treatment such as a chromate forming treatment and basically a method of coating by dipping or spraying with a treatment solution which contains 5-0.001% by weight of chromate ion is preferred. Of course it is possible to remove the excess post treatment solution by rinsing with water as required.

A film of this invention which has been formed in this way is adherent and so the film is not dispersed as a powder during the manufacture of the heat exchanger or when the heat exchanger is in operation and in contrast to conventional films where a water rinse cannot be carried out after the film treatment and where the attachment of the film is poor it is possible to prevent the occurrence of pollution in the operating environment when the heat exchanger is in operation. The invention is described by way of examples below.

EXAMPLES 1-7

Degreased and cleaned aluminum material (A1100 material) was dipped for 10 seconds, 15 seconds, 30 seconds, 1 minute, 3 minutes, 5 minutes or 7 minutes in a treatment solution which contained $Na_2SiF_6$, $FeF_3$, $ZnF_2$ and HF and of which the pH had been adjusted to 4-5 so that the composition of the bath was 6.8 g/l of sodium, 4.1 g/l of silicon, 17.1 g/l of fluorine, 0.77 g/l of zinc and 0.5 g/l of iron and which had been heated to 60° C. in a stainless steel tank, after which the treated materials were rinsed with water, dewatered and dried, whereupon a uniform gray film was found to have been formed.

The angle of contact of water with the surface of the film treated aluminum material was measured in each case, corrosion resistance tests were carried out until 5% white rust had been formed in a salt water spray test and the adhesion of the film was also examined. The results of these tests were as shown in Table 1. The treatment solution was not completely transparent and some of the undissolved material was present in a state of suspension.

EXAMPLES 8-10

A treatment solution of the same composition as used in Examples 1-7 except for the exclusion of the iron was placed in an iron tank and heated to 60° C. and degreased and cleaned aluminum material (A5052 material) was then dipped in this solution in the same way as in the earlier examples for a period of 1 minute, 3 minutes or 5 minutes, after which the samples were rinsed with water, dewatered and dried, whereupon it was found that a uniform gray skin film had been formed.

The skin film treated aluminum materials were then subjected to angle of contact of water, corrosion resistance and film adhesion tests in the same way as in Examples 1 to 7 and the results obtained were as shown in Table 1.

EXAMPLES 11-14

The aluminum materials obtained in Examples 1-4 were dipped for 30 seconds in a treatment solution at 50° C. which contained 1.5 g/l of chromic acid, after which the materials were rinsed with water, dewatered and dried. These materials were then tested in the same way as in the earlier examples and the results obtained were as shown in Table 1.

EXAMPLES 15-20

The aluminum materials obtained in Examples 5-10 were dipped for 1-2 minutes into a lubricant of which the principal component was a sodium soap and after coating with about 10 g/m$^2$ of lubricant in this way the materials were formed into round tubes by drawing after cold forging and in this way it was possible to obtain products which had good surfaces and with which there was virtually no blockage of the metal die.

REFERENCE EXAMPLE 1

A treatment solution of the same composition as in Example 1 but excluding iron was placed in a stainless steel tank and heated to 60° C. and films were formed on degreased and cleaned aluminum material (A1100 material) by dipping for 30 seconds in this solution, following the same procedure as in Example 1. The angle of contact of water was measured and corrosion resistance and adhesion tests were then carried out in the same way as in Example 1 and the results obtained were as shown in Table 1.

REFERENCE EXAMPLE 2

A treatment solution of the same composition as in Example 1 but excluding zinc was placed in a stainless steel tank and heated to 60° C. and skin films were formed on degreased and cleaned aluminum material (A1100 material) by dipping for 15 minutes in this solution, following the same procedure as in Example 1. Tests were then carried out in the same way as in Reference Example 1 and the results obtained were as shown in Table 1.

REFERENCE EXAMPLE 3

Tests were carried out in the same way as in the aforementioned examples and reference examples after cleaning aluminum material as for use in Example 1 and the results obtained were as shown in Table 1.

REFERENCE EXAMPLE 4

A treatment solution of the same composition as in Example 1 but excluding iron was placed in a stainless steel tank and heated to 60° C. and degreased and cleaned aluminum material (A5052 material) was dipped in this solution for a period of 1 minute, 3 minutes or 5 minutes, following the same procedure as in Example 1, after which the materials were rinsed with water, dewatered and dried. The resulting film weights were about 2.5 g/m$^2$, about 5 g/m$^2$ and about 6 g/m$^2$ respectively but the adhesion of the films was poor and the films peeled off when the materials were handled.

Furthermore these materials were coated with about 10 g/m$^2$ of lubricant of which the principal component was sodium soap in the same way as in Example 15 and round tubes were then produced by cold forging and drawing in the same way as in Example 15. The resulting products had scratches on the surface and die blockage occurred, which is to say that the stripped film adhered to the die.

TABLE 1

| | Weight of Film g/m$^2$ | Contact Angle | Corrosion Resistance Hours | Film Adhesion |
|---|---|---|---|---|
| Example 1 | 0.4 | Less than 10° | 72 | No Peeling |
| Example 2 | 0.7 | " | 96 | " |
| Example 3 | 2.0 | " | 96 | " |
| Example 4 | 3.5 | " | 96 | " |
| Example 5 | 6.5 | " | 120 | " |
| Example 6 | 8.0 | " | 120 | " |
| Example 7 | 9.5 | " | 120 | " |
| Example 8 | 3.0 | " | 96 | " |
| Example 9 | 6.0 | " | 120 | " |
| Example 10 | 8.0 | " | 120 | " |
| Example 11 | 0.4 | " | 200 | " |
| Example 12 | 0.7 | " | 200 | " |
| Example 13 | 2.0 | " | 200 | " |
| Example 14 | 3.0 | " | 200 | " |
| Ref. Ex. 1 | 1.8 | " | 72 | 50% Peeled |
| Ref. Ex. 2 | 0.1 | " | 72 | 100% Peeled |
| Ref. Ex. 3 | — | 70° | 1 | — |

TEST METHODS

Contact Angle: The contact angle of water was measured using a goniometer.

Corrosion Resistance: Salt water spray tests were carried out in accordance with JIS-Z-2371 and the time required to produce 5% white rusing (area) was obtained.

Film Adhesion: Tape was applied to the material and then peeled off, after which the state of peeling of the film was observed.

What is claimed is:

1. An aqueous solution comprising 0.7 to 14 g/l alkali metal, 0.4 to 8 g/l silicon, 2 to 34 g/l fluorine, 0.01 to 1.5 g/l zinc and 0.05 to 1.0 g/l iron.

2. The solution of claim 1 exhibiting a pH value of 3 to 7.

3. The solution of claim 1 comprising 2 to 8 g/l alkali metal, 1.5 to 6 g/l silicon, 5 to 24 g/l fluorine, 0.2 to 1.0 g/l zinc and 0.1 to 1.0 g/l iron.

4. The solution of claim 3 exhibiting a pH value of 4 to 5.

5. The process of forming a film on the surface of aluminum or an aluminum alloy comprising contacting the surface with the solution of claim 1.

6. The process of claim 5 further comprising the subsequent step of subjecting the film to a post treatment.

7. The process of claim 6 wherein the post treatment is a chromate solution.

* * * * *

UNITED STATES PATENT AND TRADEMARK OFFICE

CERTIFICATE OF CORRECTION

PATENT NO. : 4,650,525

DATED : March 17, 1987

INVENTOR(S) : Atsunori Yoshida, et al

It is certified that error appears in the above-identified patent and that said Letters Patent is hereby corrected as shown below:

| | |
|---|---|
| Column 2, Line 47 | Delete --0.7-1-- and insert --0.7-14-- |
| Column 2, Line 63 | Delete --1/of-- and insert --g/l of-- |
| Column 2, Line 63 | Insert the word --of-- before the word --fluorine-- |
| Column 6, Line 38 | Delete the word --rusing-- and insert --rusting--. |

Signed and Sealed this

Eleventh Day of August, 1987

*Attest:*

DONALD J. QUIGG

*Attesting Officer*

*Commissioner of Patents and Trademarks*